US010081460B2

(12) United States Patent
Painchaud et al.

(10) Patent No.: US 10,081,460 B2
(45) Date of Patent: Sep. 25, 2018

(54) DEVICE FOR CLOSING A CONTAINER INCLUDING IMPROVED SECURE CLOSURE MEANS

(71) Applicant: Nemera La Verpillière S.A.S., La Verpilliere (FR)

(72) Inventors: Gaëtan Painchaud, Francheville (FR); Frederic Alfonsi, Lyons (FR); Thierry Decock, Lyons (FR); Clement Dumet, Vaulx en Velin (FR)

(73) Assignee: Nemera La Verpillière S.A.S. (FR)

( * ) Notice: Subject to any disclaimer, the term of this patent is extended or adjusted under 35 U.S.C. 154(b) by 191 days.

(21) Appl. No.: 15/043,130

(22) Filed: Feb. 12, 2016

(65) Prior Publication Data

US 2016/0236833 A1 Aug. 18, 2016

(30) Foreign Application Priority Data

Feb. 13, 2015 (FR) ..... 15 51226
Feb. 13, 2015 (FR) ..... 15 51227

(51) Int. Cl.
*B65D 45/30* (2006.01)
*A61J 1/14* (2006.01)
(Continued)

(52) U.S. Cl.
CPC ..... *B65D 45/305* (2013.01); *A61J 1/1412* (2013.01); *A61J 1/1425* (2015.05);
(Continued)

(58) Field of Classification Search
CPC ..... A61J 1/1425; B05B 11/0032; B65D 2215/02; B65D 2215/04; B65D 50/014; B65D 50/045; B65D 50/06
See application file for complete search history.

(56) References Cited

U.S. PATENT DOCUMENTS 3,547,295 A 12/1970 Landen
3,862,699 A * 1/1975 Wetzell ..... B65D 50/045 215/216

(Continued)

FOREIGN PATENT DOCUMENTS

GB 2126201 A 3/1984
JP S5077236 U 7/1975
JP S51127853 U 10/1976

*Primary Examiner* — Anthony Stashick
*Assistant Examiner* — Mollie Impink
(74) *Attorney, Agent, or Firm* — St. Onge Steward Johnston & Reens, LLC

(57) ABSTRACT

An internal cap member intended to be placed on the container. The internal cap member carries a security ring including a security element including a locking abutment mobile radially between a cooperation position, favored by elastic biasing, in which the locking abutment cooperates with a complementary locking abutment carried by the container, and a separation position, in which the locking abutment is separated from the complementary locking abutment. The security ring is mobile axially on the cap. The closure device also includes an element for transforming the axial movement of the security ring into radial movement of the security element, making it possible for the radial position of the locking abutment to change from its cooperation position to its separation position.

17 Claims, 10 Drawing Sheets

(51) Int. Cl.

| | |
|---|---|
| ***B65D 50/06*** | (2006.01) |
| ***B65D 50/04*** | (2006.01) |
| ***B05B 11/00*** | (2006.01) |

(52) U.S. Cl.
CPC ..... *B05B 11/0032* (2013.01); *B65D 50/046* (2013.01); *B65D 50/06* (2013.01); *A61J 1/1418* (2015.05); *B65D 2215/04* (2013.01)

(56) References Cited

U.S. PATENT DOCUMENTS

| | | | | |
|---|---|---|---|---|
| 3,863,798 | A * | 2/1975 | Kurihara | B65D 41/185 215/272 |
| 4,527,701 | A | 7/1985 | Schaubeck | |
| 5,957,313 | A * | 9/1999 | Bouan | B65D 45/32 215/215 |

* cited by examiner

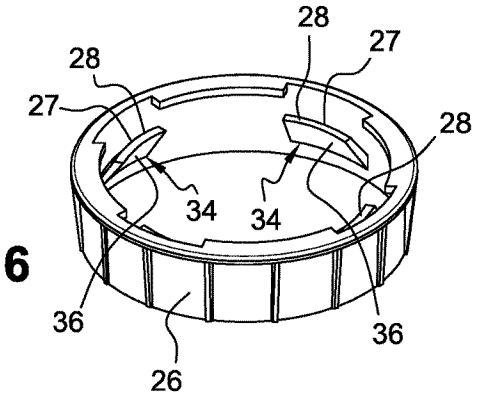
Fig. 7
Fig. 6
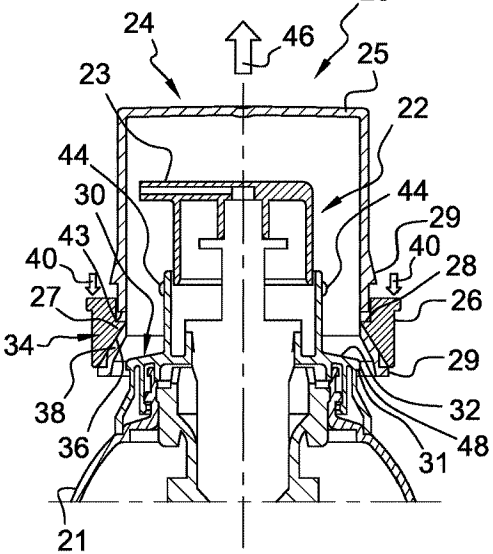
Fig. 10
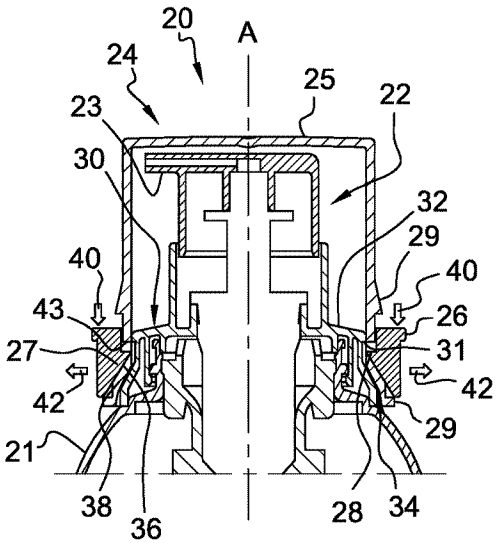
Fig. 9
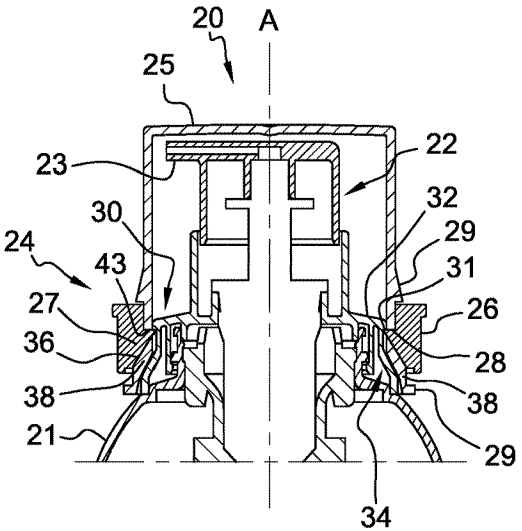
Fig. 8

DEVICE FOR CLOSING A CONTAINER INCLUDING IMPROVED SECURE CLOSURE MEANS

FIELD OF THE INVENTION

The present invention concerns a closure device that is intended to be mounted on the neck of a container also referred to as a reservoir. The container is for example intended to receive a pharmaceutical product in fluid form and may be fitted with a dispensing pump, possibly a metered dispensing pump.

BACKGROUND OF THE INVENTION

In known manner, pharmaceutical products are offered for sale in bottles usually comprising a reservoir having a neck on which is mounted a dispensing tip forming a metering pump, for example.

The dispensing tip is conventionally protected by a closure device including a cap intended to be placed on the container or to be removed from that container by relative movement between the cap and the container including an axial component.

Thus it is known to equip the closure device with means for clipping the cap onto the container that can be activated by substantially axial relative movement between the cap and the container. In this first case, the cap is placed on the container or removed from that container by a relative movement between the cap and the container including only an axial component. It is also known to use a cap having an interior screwthread screwed onto an exterior screwthread of the neck of the container. In this second case, the cap is placed on the container or removed from that container by a relative movement between the cap and the container including an axial component and a rotation component producing a screwing action.

To access the dispensing tip, it then suffices, in the first case, to pull axially on the cap, a moderate traction force generally being sufficient to unlock the clipping means by overcoming a localized resistance and, in the second case, to unscrew the cap, by applying a rotation force that is likewise moderate.

This makes it possible to render the dispensing tip accessible to everyone, including persons with little strength, for example elderly persons or convalescent persons.

The drawback is that a child can also easily access the dispensing tip and therefore the contents of the reservoir, which may be hazardous in some cases.

Moreover, as regulations evolve, more and more countries require bottled pharmaceutical products placed on sale in their territory to have secure closure means commonly referred to as child resistant closure (CRC) packaging. Such secure means for example enable a cap to be removed only by movements that are a priori mutually contradictory. These means are often difficult to use, however, and often require a relatively high physical force.

There is known from the document JP S50 77236 or GB 2 126 201 a container closure device of the type including a cap assembly including an internal cap member intended to be placed on the container or to be removed from that container by a relative movement between the internal cap member and the container including an axial component. The internal cap member carries a security element including a locking abutment mobile radially between a cooperation position, favored by elastic biasing, in which the locking abutment is intended to cooperate with a complementary locking abutment carried by the container to retain the internal cap member on the container, and a separation position, in which the locking abutment is intended to be separated from the complementary locking abutment carried by the container to allow the release of the cap member relative to the container.

SUMMARY OF THE INVENTION

The object of the invention is to propose a container closure device including effective secure closure means that are nevertheless simple to use.

To this end, the invention consists in a device for closing a container, of the type including a cap assembly including an internal cap member intended to be placed on the container or to be removed from that container by a relative movement between the internal cap member and the container including an axial component, the internal cap member carrying a security element including a locking abutment mobile radially between:

- a so-called cooperation position, favored by elastic biasing, in which the locking abutment is intended to cooperate with a complementary locking abutment carried by the container to retain the internal cap member on the container,
- a so-called separation position, in which the locking abutment is intended to be separated from the complementary locking abutment carried by the container to allow the release of the internal cap member relative to the container, characterized in that it further includes

- an external cap member mounted to be axially mobile on the internal cap member, the external cap member carrying the security element, and
- means for transforming the axial movement of the external cap member on the internal cap member into radial movement of the security element, making it possible for the radial position of the locking abutment to evolve from its cooperation position to its separation position by axial movement of the external cap member relative to the internal cap member in a direction identical to a direction of the axial component of the movement of the internal cap member toward the container during the placing of that internal cap member on the container.

Thanks to the invention, to separate the assembly forming the cap from the container, first of all, the user moves the external cap member on the internal cap member in a direction identical to a direction of the axial component of the movement of the cap assembly toward the container when placing that cap assembly on the container.

This first gesture places the locking abutment carried by the external cap member in its separation position allowing the release of the internal cap member relative to the container. However, this first gesture to separate the cap assembly from the container is not intuitive for a child because, where the axial component of this gesture is concerned, it is effected in the direction of placing that cap assembly on the container and not in the direction of removing the cap assembly.

The user then effects a second gesture to separate the cap assembly from the container during which the axial component of the relative movement between the internal cap member and the container is in a direction of removing that internal cap member from the container opposite the direction of placing that internal cap member on the container.

It will be noted that if, following the first gesture, the user gives up on separating the cap assembly from the container, the locking abutment carried by the external cap member is automatically replaced in its cooperation position by the effect of the elastic biasing.

A child does not generally spontaneously coordinate these two gestures including components in opposite directions, so that the secure closure of the container is effective against accidental manipulation by a child.

Moreover, the force that a user must apply to separate the cap assembly from the retaining member remains moderate, and even lower than that required by a conventional container closure device. In actual fact, the movement of the external cap member on the internal cap member is obtained by exerting on that external cap member a pressure that remains moderate.

The closure device in accordance with the invention may also include the following optional features.

Preferably, the means for transforming the axial movement of the external cap member into radial movement of the security element include a ramp carried by the security element intended to cooperate with a complementary ramp carried by the internal cap member.

The external cap member may be formed by at least one sector of a security ring around the internal cap member, the security element being carried by an internal surface of the sector of the security ring.

The external cap member is preferably formed by a security ring around the internal cap member.

Where appropriate, the external cap member may be formed by two diametrically opposite sectors of a security ring around the internal cap member, the ends of each sector of the security ring being connected to the internal cap member by junctions elastically deformable in the axial direction and, where necessary, in the radial direction, these elastically deformable junctions participating in the elastic biasing of the locking abutment of the security element into its cooperation position.

The closure device advantageously includes axially acting elastic biasing means connected to the internal cap member or to the external cap member so as to bias the external cap member toward a position favoring the cooperation position of the locking abutment of the security element.

The axially acting elastic biasing means may include an annular element connected to the external cap member, for example made in one piece with that external cap member.

Where appropriate, the internal cap member and the external cap member each include a substantially cylindrical lateral wall closed by an end wall, the axially acting elastic biasing means including at least one elastic element interleaved between the end walls of the internal cap member and the external cap member and preferably at least one axial travel limiting abutment between the internal cap member and the external cap member interleaved between the end walls.

The elastic element is preferably formed by a puncture in the end wall of the internal cap member.

The security element is preferably elastically deformable in the radial direction relative to the external cap member that carries it, this security element elastically deformable in the radial direction participating in the elastic biasing of the locking abutment of the security element into its cooperation position.

Where appropriate, the external cap member is elastically deformable in the radial direction and participates in the elastic biasing of the locking abutment of the security element into its cooperation position.

The closure device advantageously includes at least two security elements regularly distributed on the external cap member around an axis parallel to the axial direction of movement of the external cap member on the internal cap member.

The closure device preferably includes means providing localized resistance, for example bosses, carried by the internal cap member, intended to cooperate with the complementary locking abutment carried by the container to prevent unintentional separation of the internal cap member relative to the container when the locking abutment of the security element is in its separation position.

The external cap member may be clipped onto the internal cap member between two axial abutments for limiting an axial travel of the external cap member on the internal cap member.

Where appropriate, the external cap member includes two openings for positioning the fingers of a user, these openings being each delimited by a contour forming an axial bearing surface.

The cap assembly may include means for locking together the internal cap member and the external cap member, activated on release of the internal cap member relative to the container, including two elastic tongues for contact with the fingers of a user, respectively lying in the two openings for positioning the fingers of that user, each tongue including a radial locking projection that can be nested in a complementary locking orifice in the internal cap member.

The internal cap member and the external cap member advantageously include complementary axial guiding means adapted to limit the axial travel between them, including for example at least one axial guide projection carried by the external cap member sliding axially in a complementary axial guide orifice in the internal cap member.

The cap assembly preferably includes means for centering the external cap member around the internal cap member, including for example centering ribs carried by the external cap member.

The security element preferably extends radially through an orifice in the internal cap member.

Thanks to the security element passing through this orifice, means can be formed that participate in the connection between the external cap member and the internal cap member, which means that they can be removed together from the container.

The complementary ramp carried by the internal cap member may form a portion of the contour of the orifice in the internal cap member.

In accordance with one embodiment, the locking abutment carried by the security element and the complementary locking abutment carried by the container are both axial abutments.

In accordance with one embodiment, the internal cap member includes an interior screwthread intended to cooperate with an exterior screwthread carried by the container so that the relative movement between the internal cap member and the container enabling the internal cap member to be placed on the container or to be removed from that container is a relative screwing movement so that this relative movement includes a rotation component in addition to the axial component.

In accordance with one embodiment, the locking abutment carried by the security element and the complementary locking abutment carried by the container are both circumferential abutments.

The internal cap member and the external cap member advantageously each include a lateral wall closed by an end wall, the closure device further including a security abutment fastened to the internal cap member that continues or comes to project through the end wall of the external cap member when the security element moves from its cooperation position to its separation position.

Accordingly, if a child attempts to press the end wall of the external cap member against a surface such as the floor or a table, for example, the security abutment comes into contact with that surface. This prevents the axial movement of the end wall of the external cap member toward the configuration that releases the security means, so that there is no risk of the closure device being opened.

The invention also consists in a medical device including a container and a device for closing that container, characterized in that the closure device is a device in accordance with the invention.

The medical device in accordance with the invention may also include the following optional features.

The medical device advantageously further includes means for clipping the internal cap member onto the container that can be activated by substantially axial relative movement between the internal cap member and the container.

The complementary locking abutment is preferably carried by a member for retaining the internal cap member on the container, this retaining member forming for example a tip for dispensing a product contained in the container, being intended to be mounted on the container or being made in one piece with that container.

BRIEF DESCRIPTION OF THE DRAWINGS

The invention will be better understood after examining the appended figures, which are provided by way of example and have no limiting character, in which:

FIG. 6 is a perspective view of a security ring forming an external cap member of the closure device from FIG. 1;

FIG. 7 is a view analogous to that of FIG. 6 showing a variant embodiment of the security ring;

FIGS. 8 to 10 are views analogous to those of FIGS. 2 to 4 of a medical device including a closure device in accordance with a second embodiment of the invention mounted on a container;

DETAILED DESCRIPTION OF THE INVENTION

Figure 3:
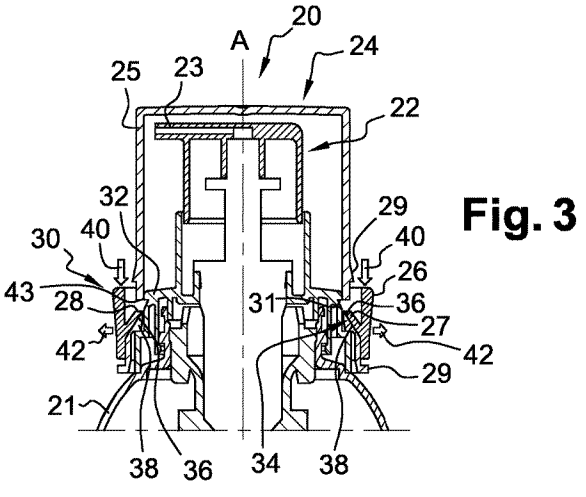
FIGS. 2 to 5 are views in axial section of the closure device from FIG. 1 in various configurations of use of that closure device.

A medical device 20 in accordance with the invention is shown in FIGS. 1 to 6. This medical device 20 includes a container 21 forming a reservoir, having a general shape that is circularly symmetrical about an axis A. A tip 22 for dispensing a product contained in the reservoir is mounted on the container 21. Alternatively, this dispensing tip 22 could be made in one piece with the container 21. In the example described here, the dispensing tip 22 includes, in a manner that is known in itself, a dispensing nozzle 23 that can be activated by a user by axial movement of this dispensing nozzle 23 against elastic biasing force.

Hereinafter, a direction will be described as axial, radial or orthogonal with reference to the axis A. An axial direction is therefore parallel to the axis A.

The medical device 20 also includes a device 24 for closing the container 21 conforming to a first embodiment of the invention shown in FIGS. 1 to 6.

This closure device 24 includes an assembly forming a protective cap including an internal cap member 25 and an external cap member 26. The internal cap member 25 is intended to be placed on the container 21 or to be removed therefrom by a relative movement between the internal cap member 25 and the container 21 including an axial component, i.e. a component substantially parallel to the axis A.

In the embodiment shown in FIGS. 1 to 6, the closure device 24 includes an external cap member 26 forming a security ring 26. This security ring 26 forms a security member around the internal cap member 25 and is mounted so as to be axially mobile.

An internal surface of the security ring 26 carries a plurality of security projections forming security elements 27 each including an axial locking abutment 28.

The security ring 26 is clipped onto the internal cap member 25 between two axial abutments 29 for limiting an axial travel of this security ring 26 on the internal cap member 25.

The locking abutments 28 and the security ring 26 are parts of clipping means 30 intended to retain the closure device 24 on the container 21. These clipping means 30 further include a complementary axial locking abutment 31 carried by a flange 32 of the dispensing tip 22.

The clipping means 30 of the medical device 20 therefore enable the internal cap member 25 to be clipped onto the dispensing tip 22. These clipping means 30 can be activated by substantially axial relative movement between the internal cap member 25 and the dispensing tip 22.

In the embodiment of FIGS. 1 to 6, the relative movement between the internal cap member 25 and the container 21 enabling the internal cap member 25 to be placed on the container 21 or to be removed from that container 21 therefore has in practice only an axial component.

Each locking abutment 28 carried by the security ring 26 itself carried by the internal cap member 25 can be moved radially between a so-called cooperation position, favored by elastic biasing, and a so-called separation position.

Figure 2:
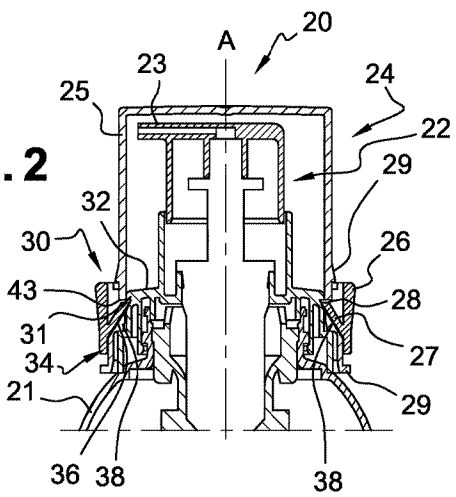

In the cooperation position, each locking abutment 28 is intended to cooperate with the complementary locking abutment 31 carried by the dispensing tip 22 to retain the internal cap member 25 on the container 21, as shown in FIG. 2.

Figure 5:
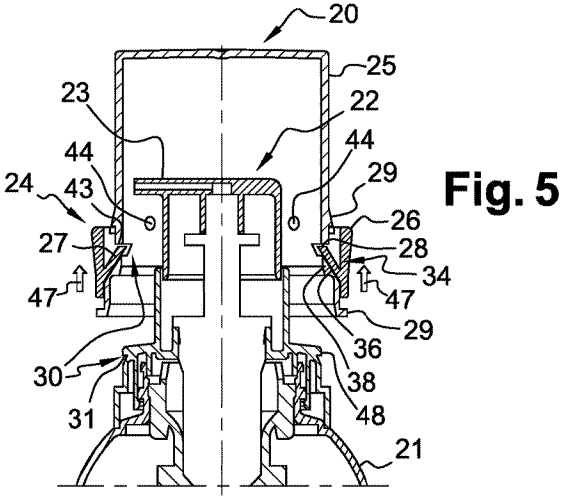
Figure 4:
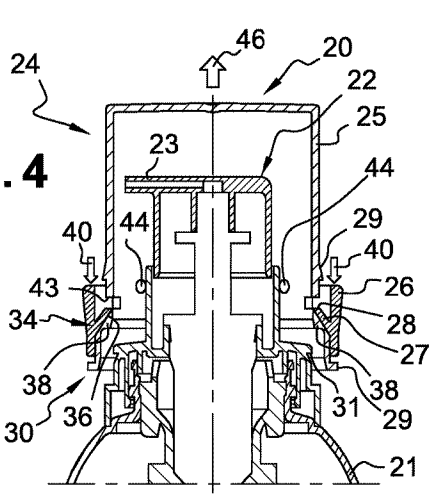

In the separation position, each locking abutment 28 is intended to be separated from the complementary locking abutment 31 carried by the dispensing tip 22 to allow the release of the internal cap member 25 relative to the container 21, as shown in FIGS. 3 to 5.

The dispensing tip 22 therefore forms a member for retaining the internal cap member 25 on the container 21.

As the complementary locking abutment 31 carried by the flange 32 is circularly symmetrical, the internal cap member 25 can be placed on the dispensing tip 22 in any angular position about the axis A.

The closure device 24 also includes means 34 for transforming an axial movement of the security ring 26 on the internal cap member 25 into a radial movement of the security elements 27. These transformation means 34 make it possible for the radial position of each locking abutment 28 carried by each security element 27 of the security ring 26 to change from its cooperation position to its separation position by axial movement of the security ring 26 relative to the internal cap member 25. This axial movement of the security ring 26 relative to the internal cap member 25 is in an axial direction identical to the direction of the axial movement of the cap assembly 25, 26 toward the container 21 when placing that cap assembly 25, 26 on the container 21.

The transformation means 34 include a ramp 36 carried by each security element 27 intended to cooperate with a complementary ramp 38 carried by the internal cap member 25.

As shown in FIG. 3, these two complementary ramps 36, 38 cooperate with each other to transform the axial movement (represented by arrows 40) of the security ring 26 into a radial movement (represented by arrows 42) in a direction orthogonal to the axis A of the security elements 27 of the security ring 26.

It will be noted that the security element 27 extends radially through an orifice 43 in the internal cap member 25. The complementary ramp 38 carried by the internal cap member 25 forms a portion of the contour of the orifice 43 in the internal cap member 25.

The security element 27 passing through the orifice 43 forms means that participate in the connection between the external cap member 26 and the internal cap member 25, with the result that they can be removed together from the container.

In actual fact, while the user is removing the closure device 24 from the container 21, the complementary ramp 38 comes to abut against the contour of the orifice 43 of the internal cap 25. This limits the axial travel of the security ring 26 on the internal cap member 25 and therefore prevents separation of the security ring 26 from the internal cap member 25.

In the embodiment shown in FIGS. 1 to 6, each security element 27 is formed by a lug elastically deformable in the radial direction relative to the security ring 26 that carries it. Each radially elastically deformable security element 27 therefore favors the cooperation position of the locking abutment 28 by participating in the elastic biasing of that locking abutment 28 toward its cooperation position shown in FIG. 2.

The security ring 26 may include four security elements 27, to be more specific four lugs elastically deformable in the radial direction as shown in FIG. 6. These four security elements 27 are regularly distributed on the security ring 26 around an axis parallel to the axial direction of movement of the security ring 26 on the internal cap member 25.

Alternatively, the security ring 26 may include a different number of security elements 27 regularly arranged on the security ring 26, for example at least two security elements 27, as shown in FIG. 7.

Moreover, the closure device 24 includes means providing localized resistance, for example bosses 44, carried by the internal cap member 25. These bosses 44, visible in FIGS. 4 and 5, are intended to cooperate with the complementary locking abutment 31 carried by the distribution tip 22 to prevent unintended separation of the cap assembly 25, 26 relative to the dispensing tip 22 when the locking abutments 28 are in their separation position.

The principal steps of manipulating the medical device 20 in accordance with the invention will be described hereinafter.

Consider first of all the medical device 20 in its closed configuration as shown in FIG. 2. In this case, the internal cap member 25 is clipped onto the dispensing tip 22, the clipping means 30 being activated.

To separate the cap assembly 25, 26 from the dispensing tip 22 the user moves the security ring 26 on the internal cap member 25 in the direction of the arrows 40 (see FIGS. 3 and 4). This direction of movement corresponds to the direction of axial movement of the cap assembly 25, 26 toward the container 21 when placing the cap assembly 25, 26 on the container 21.

Thanks to the transformation means 34, the axial movement of the security ring 26 on the internal cap member 25 is transformed into a radial movement of the security elements 27. This enables the radial position of each locking abutment 28 to evolve, through cooperation of the ramps 36 carried by the security elements 27 and the complementary ramps 38 carried by the internal cap member 25, from its cooperation position to its separation position. This change of position is shown in FIG. 3 by the arrows 42.

Figure 1:
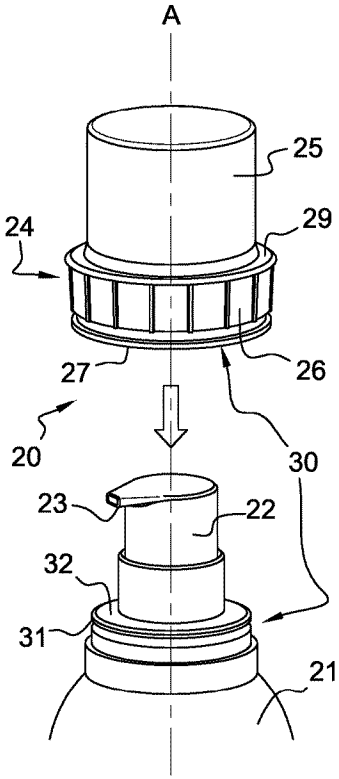
FIG. 1 is a perspective view of a medical device including a closure device in accordance with a first embodiment of the invention mounted on a container.

Then, by a habitual gesture, the user (whilst maintaining pressure as shown by the arrows 40 on the security ring 26 relative to the internal cap member 25) separates the internal cap member 25 from the dispensing tip 22 by an axial movement of the internal cap member 25 relative to the dispensing tip 22, in the direction of the arrows 46 shown in FIG. 4, without releasing the load applied to the security ring 26 as shown by the arrows 40. After the complementary locking abutment 31 of the dispensing tip 22 has moved past the bosses 44 carried by the internal cap member 25, the medical device 20 is then in its open configuration as shown in FIGS. 1, 4 and 5.

It will be noted that the axial abutments 29 for limiting the axial travel of the security ring 26 on the internal cap member 25 prevent separation of the security ring 26 from the internal cap member 25 while the user is removing the closure device 24 from the container 21.

It will also be noted, as can be seen in FIG. 5, that as soon as the user ceases to exert a force on the security ring 26 as shown by the arrows 40 it instantaneously returns to a position in which the locking abutments 28 are in their cooperation position by virtue of the elastic biasing as shown by the arrows 47.

To close the medical device 20 again, the user clips the internal cap member 25 onto the dispensing tip 22 by moving it substantially axially (parallel to the axis A) toward that dispensing tip 22. It will be noted that a retraction ramp 48 is provided on the flange 32 of the dispensing tip 22 (see FIG. 5).

During the movement clipping the internal cap member 25 onto the dispensing tip 22, each security element 27 is therefore retracted by cooperation between the ramp 36 carried by the security element 27 and the retraction ramp 48 carried by the dispensing tip 22. This retraction, which allows the security elements 27 to get past the flange 32, therefore precedes the placing of the locking abutments 28, 31 of the security elements 27 and the dispensing tip 22 in the cooperation position.

After the locking abutments 28, 31 are caused to cooperate, the internal cap member 25 is retained on the dispensing tip 22, as shown in FIG. 2.

Other embodiments of the invention will be described hereinafter with reference to FIGS. 8 to 33. In those FIGS. 8 to 33, elements analogous to those in the preceding FIGS. are designated by identical references.

There is shown in FIGS. 8 to 10 a medical device 20 including a closure device 24 in accordance with a second embodiment of the invention. This closure device 24 is mounted on the container 21.

Differing from the first embodiment, in this case, it is the security ring 26 as a whole (and no longer each lug forming a security element 27) that is elastically deformable in the radial direction and therefore participates in the elastic biasing of the locking abutment 28 of the security element 27 into its cooperation position.

The principal steps of manipulating the medical device 20 including the closure device 24 in accordance with the second embodiment are deduced, mutatis mutandis, from those of the medical device 20 including the closure device 24 in accordance with the first embodiment: FIG. 8 is analogous to FIG. 3, FIG. 9 is analogous to FIG. 4, and FIG. 10 is analogous to FIG. 5.

There is represented in FIGS. 11 to 14 a medical device 20 including a closure device 24 in accordance with a third embodiment of the invention. This closure device 24 is mounted on the container 21.

In this case, the dispensing tip 22 is a droplet dispenser operating in a manner known in itself. The dispensing tip 22 is screwed onto a threaded neck 50 of the container 21.

Moreover, the closure device 24 in accordance with this third embodiment includes an internal cap member 25 including an interior screwthread 52 intended to cooperate with an exterior screwthread 54 carried by the dispensing tip 22 to enable relative screwing movement between the cap assembly 25, 26 and the dispensing tip 22. Alternatively, it could be envisaged that the exterior screwthread 54 be carried directly by the container 21 and enable relative screwing movement between the cap assembly 25, 26 and the container 21.

Figure 14:
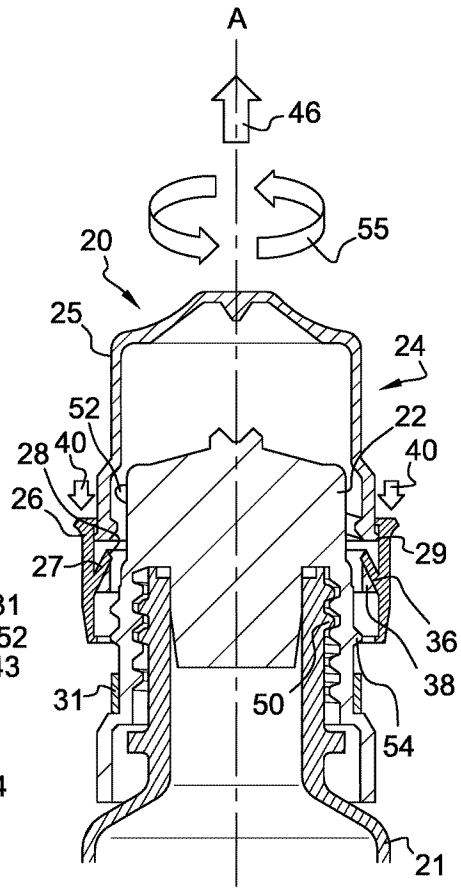
FIGS. 11 to 14 are views analogous to those of FIGS. 1 to 4 of a medical device including a closure device in accordance with a third embodiment of the invention mounted on a container.
Figure 11:
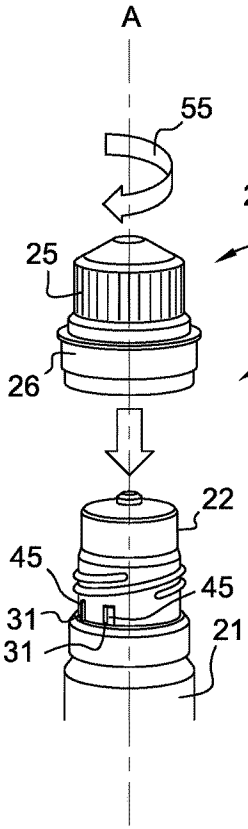

The internal cap member 25 including an interior screwthread 52 intended to cooperate with the exterior screwthread 54 carried by the dispensing tip 22, the relative movement between the internal cap member 25 and the dispensing tip 22 enabling the internal cap member 25 to be placed on the dispensing tip (or to be removed from this dispensing tip 22) is therefore a relative screwing movement 55 so that this relative movement includes a rotation component as shown by the arrows 55 in FIGS. 11 and 14 in addition to the axial component parallel to the axis A.

In the first and second embodiments of the invention, each locking abutment 28 carried by each security element 27 and the complementary locking abutment 31 carried by the container 21 are all axial abutments. Differing from these embodiments of the invention, in the third embodiment of the invention, each locking abutment 28 carried by each security element 27 and its complementary locking abutment 31 carried by the container 21 are all circumferential abutments.

In actual fact, in this third embodiment of the invention, each deformable lug forming a security element 27 is delimited by a pair of circumferential locking abutments 28 intended to cooperate with a pair of complementary locking abutments 31 carried by the dispensing tip 22 (see FIG. 11).

In this third embodiment of the invention, each locking abutment 28 is therefore mobile radially between:

- the cooperation position, favored by the elastic biasing of the security element 27 carrying the locking abutment 28, in which this locking abutment 28 cooperates with a complementary circumferential locking abutment 31 carried by the dispensing tip 22, and
- the separation position, in which the locking abutment 28 is separated from the complementary circumferential locking abutment 31 of the dispensing tip 22 to allow the release of the internal cap member 25 relative to the container 21.

It will be noted that the locking abutments 28 cooperate with the complementary locking abutments 31 when the internal cap member 25 is at the end of the screwing travel onto the dispensing tip 22.

It will also be noted that each pair of complementary circumferential locking abutments 31 is delimited by a pair of circumferential ramps 45 favoring nesting, between the complementary circumferential locking abutments 31 of that pair, of the pair of locking abutments 28 of a security element 27 at the end of the screwing travel of the internal cap member 25.

Moreover, in this third embodiment, the axial abutments 29 for limiting the axial travel of the security ring 26 on the internal cap member 25 are carried by the edges of each orifice 43 in the internal cap member 25.

The principal steps of manipulating the medical device 20 in accordance with this third embodiment will be described hereinafter.

Figure 12:
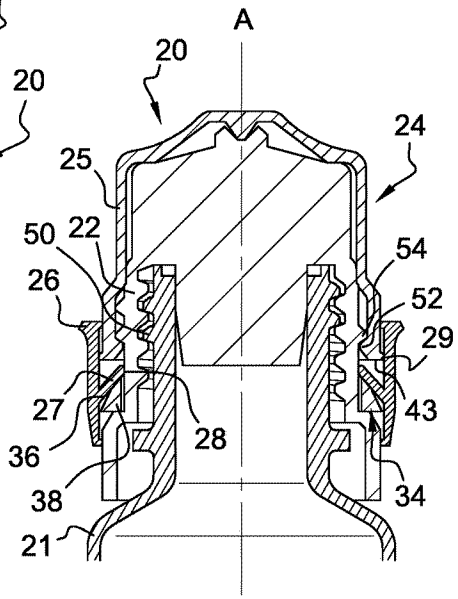

Consider first of all the medical device 20 in its closed configuration as shown in FIG. 12. In this case, the internal cap member 25 is screwed onto the dispensing tip 22.

Figure 13:
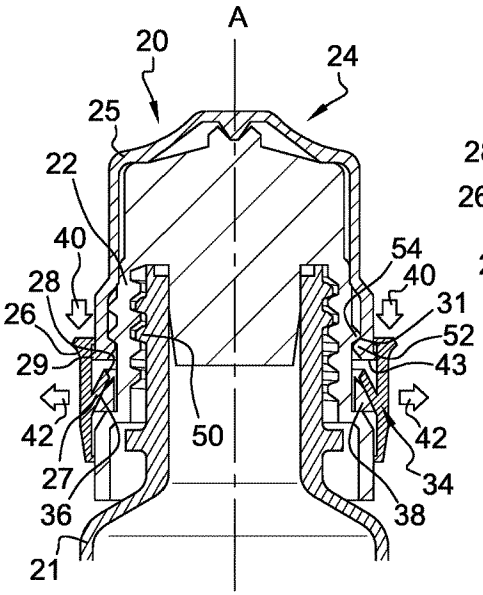

To separate the cap assembly 25, 26 from the dispensing tip 22, a user moves the security ring 26 on the internal cap member 25 in the direction of the arrows 40 in FIGS. 13 and 14 corresponding to the direction of the axial component of the movement of the cap assembly 25, 26 toward the container 21 when screwing the cap assembly 25, 26 onto the container 21.

Thanks to the transformation means 34, the axial movement of the security ring 26 on the internal cap member 25 is transformed into a radial movement of the security elements 27 therefore enabling the radial position of each locking abutment 28 to evolve, through cooperation of the ramps 36 carried by the security elements 27 and the complementary ramps 38 carried by the internal cap member 25, from its cooperation position to its separation position. This change of position is shown in FIG. 13 by the arrows 42.

Then, in accordance with a habitual gesture, the user (whilst maintaining a pressure in the direction of the arrows 40 on the security ring 26) unscrews the internal cap member 25 form the dispensing tip 22 in the direction of the arrows 46 and 55 shown in FIG. 14. The medical device 20 is then in its open configuration as shown in FIG. 11.

It will be noted that the axial abutments 29 for limiting the axial travel of the security ring 26 on the internal cap member 25 prevent separation of the security ring 26 from the internal cap member 25 while the user is removing it from the container 21.

It will also be noted that as soon as the user ceases to exert a force on the security ring 26 in the direction 40, it immediately returns to its cooperation position by virtue of the elastic biasing effect.

To close the medical device 20 again, the user screws the cap assembly 25, 26 onto the dispensing tip 22. It will be noted that the exterior screwthread 54 of the dispensing tip 22 forms the retraction ramp 48.

When screwing the internal cap member 25 onto the dispensing tip 22, each security element 27 is therefore retracted by cooperation between the ramp 36 carried by the security element 27 and the retraction ramp 48 formed by the exterior screwthread 54. This retraction of the security elements 27 therefore precedes the placing in the cooperation position of the locking abutments 28, 31 of the security elements 27 of the security ring 26 and the dispensing tip 22.

After the locking abutments 28, 31 come to cooperate, the internal cap member 25 is prevented from turning around the dispensing tip 22, as shown in FIG. 12. Thus the internal cap member 25 cannot be unscrewed from the dispensing tip 22 without acting on the security ring 26.

Figure 15:
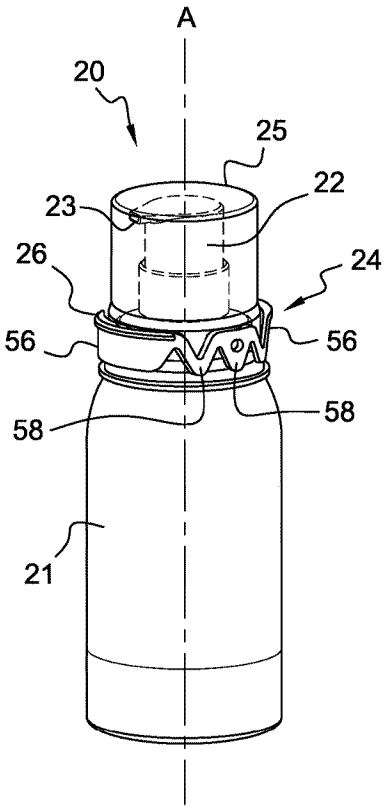
FIG. 15 is a perspective view of a medical device including a closure device in accordance with a fourth embodiment of the invention mounted on a container.
Figure 18:
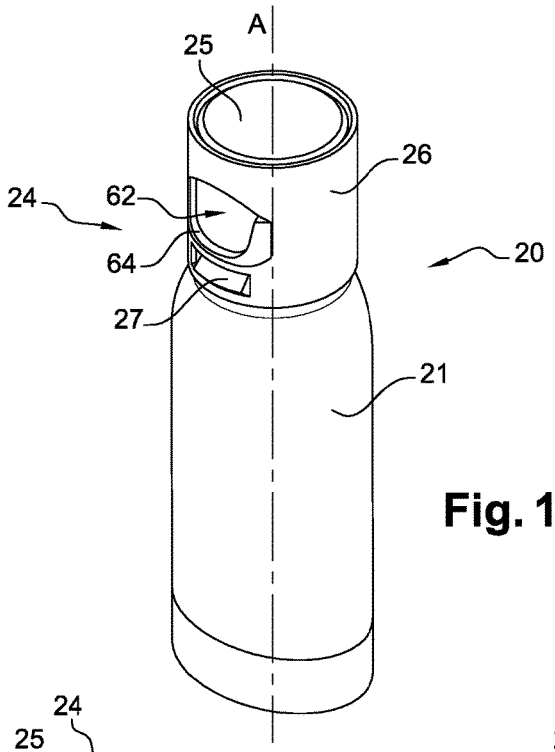
FIG. 18 is a perspective view of a medical device including a closure device in accordance with a sixth embodiment of the invention mounted on a container.

There is shown in FIG. 15 a medical device 20 including a closure device 24 in accordance with a fourth embodiment of the invention. This closure device 24 is mounted on the container 21.

As in the first and second embodiments of the invention, the internal cap member 25 is clipped onto the retaining member 22. The relative movement between the cap assembly 25, 26 and the container 21 enabling the cap assembly 25, 26 to be placed on the container 21 or to be removed from that container 21 therefore in practice has only an axial component.

Moreover, as in the first and second embodiments of the invention, each locking abutment 28 carried by the security element 27 and the complementary locking abutment 31 carried by the container 21 are all axial abutments.

In this fourth embodiment, the external cap member 26 is formed by at least one sector of a security ring 26 around the internal cap member 25, each security element 27 being carried by an internal surface of the sector of the external cap member 26.

In actual fact, in this fourth embodiment, the closure device 24 includes an external cap member 26 around the internal cap member 25 formed by two diametrically opposite sectors 56 of a security ring 26, the security elements 27 being carried by an internal surface of those sectors 56. The ends of each sector 56 of the external cap member 26 are connected to the internal cap member 25 via junctions 58 that are elastically deformable in the axial direction and, where appropriate, in the radial direction. The elastically deformable junctions 58 participate in the elastic biasing of the locking abutment 28 of each security element 27 into its cooperation position. Each junction 58 is connected to the internal cap member 25 in a manner known in itself.

Figure 17:
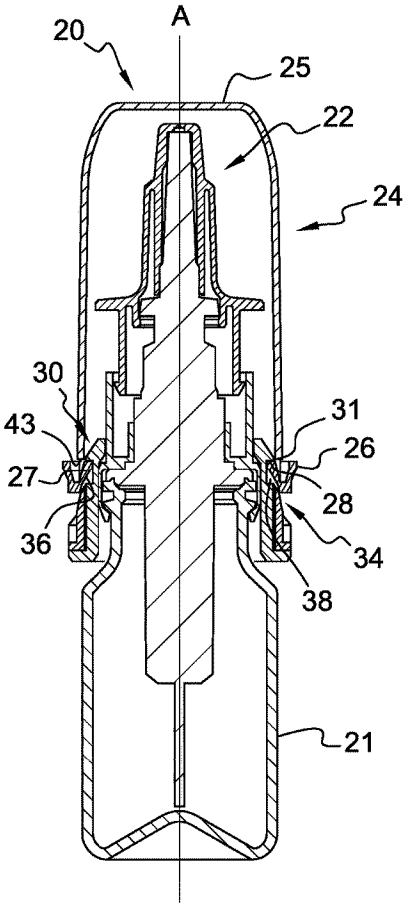
FIG. 17 is a view in axial section of the medical device from FIG. 16.
Figure 16:
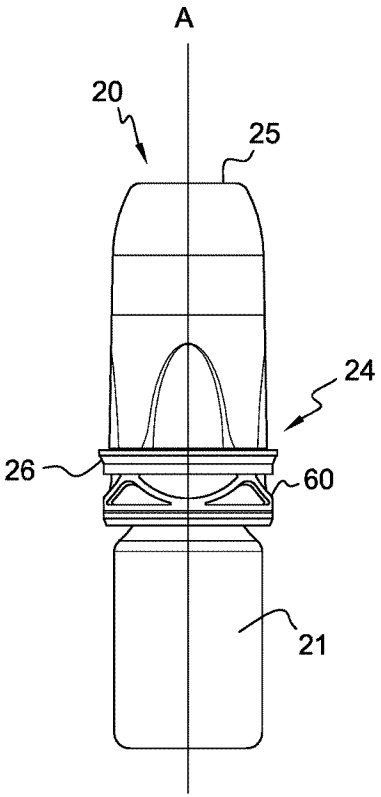
FIG. 16 is a front view of a medical device including a closure device in accordance with a fifth embodiment of the invention mounted on a container.

There is shown in FIGS. 16 and 17 a medical device 20 including a closure device 24 in accordance with a fifth embodiment of the invention. This closure device 24 is mounted on the container 21.

As in the first and second embodiment of the invention, the cap assembly 25, 26 is clipped onto the retaining member 22. The relative movement between the cap assembly 25, 26 and the container 21 enabling the protection cap assembly 25, 26 to be placed on the container 21 or to be removed from that container 21 therefore has in practice only an axial component.

Moreover, as in the first and second embodiments of the invention, each locking abutment 28 carried by the security element 27 and the complementary locking abutment 31 carried by the container 21 are all axial abutments.

In this fifth embodiment, the closure device 24 includes axially acting elastic biasing means 60 including an annular element 60 connected to the external cap member 26. The biasing means 60, made in one piece with the external cap member 26, for example, bias the external cap member 26 toward a position favoring the cooperation position of the locking abutment 28 of the external cap member 26 with the locking abutment 31 carried by the flange 32 of the retaining member 22 of the internal cap member 25 on the container 21.

There is shown in FIGS. 18 to 25 a medical device 20 including a closure device 24 in accordance with a sixth embodiment of the invention. This closure device 24 is mounted on the container 21.

Figure 19:
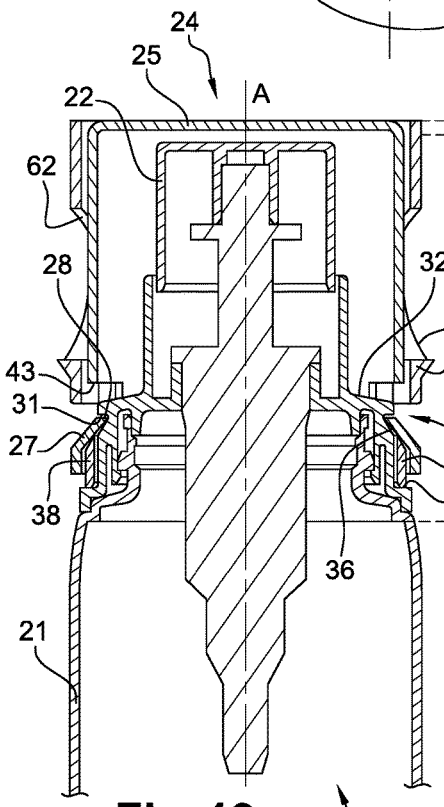
FIGS. 19 and 20 are views in axial section of the closure device from FIG. 18 in various configurations of use of that closure device.
Figure 20:
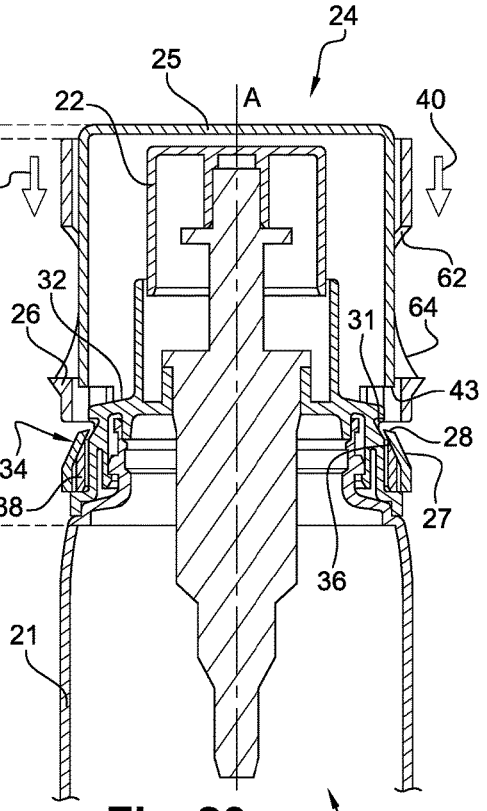

As can be seen in FIGS. 19 and 20, this sixth embodiment is close to the first embodiment. Unlike the latter, however, in this case the external cap member 26 forms a security ring 26 having a greater axial dimension (parallel to the direction of the axis A). As in the first embodiment, the external cap member 26 carries two deformable lugs forming the security elements 27, the clipping means 30 and the transformation means 34.

Figure 25:
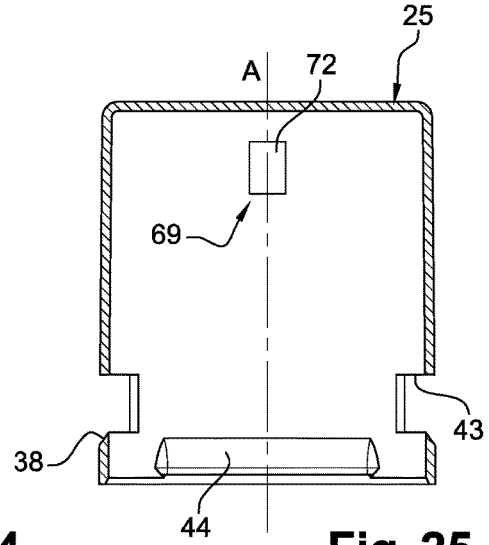
FIG. 25 is a view in axial section of the internal cap member of the closure device form FIG. 18.
Figure 26:
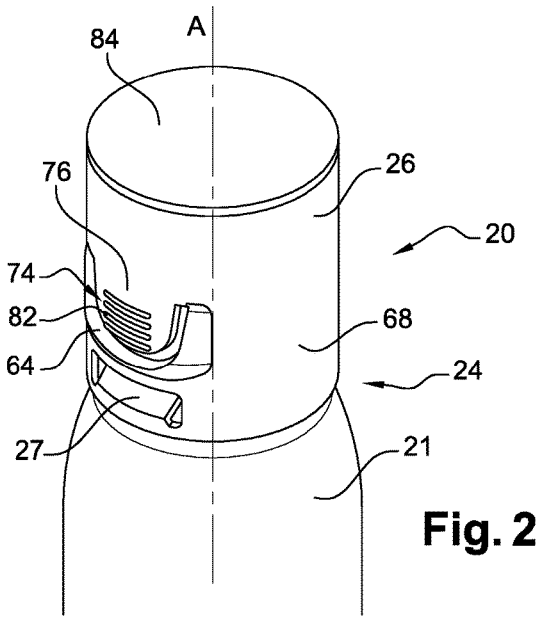
FIGS. 26 to 33 are figures analogous to FIGS. 18 to 25 showing a medical device including a closure device in accordance with a seventh embodiment of the invention.

In the closure device 24 in accordance with the sixth embodiment, the means providing localized resistance comprise the bosses 44 the shapes of which can be seen in FIG. 25. As in the first embodiment, these bosses 44, carried by the internal cap member 25, are intended to cooperate with the complementary locking abutment 31 carried by the dispensing tip 22 to prevent unintended separation of the cap assembly 25, 26 relative to the dispensing tip 22 when the locking abutments 28 are in their separation position.

Figure 21:
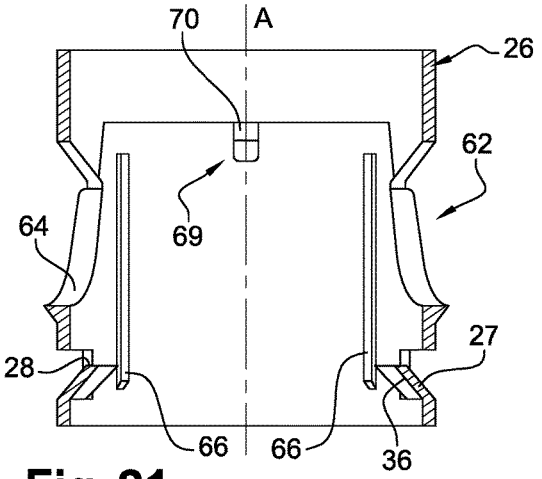
FIG. 21 is a view in axial section of an external cap member of the closure device from FIG. 18.
Figure 22:
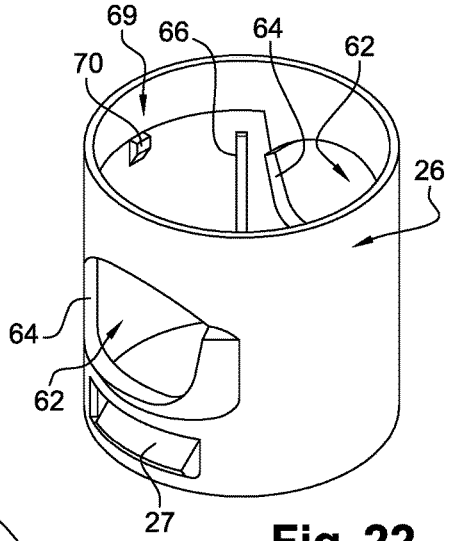
FIGS. 22 and 23 are perspective views of the external cap member of the closure device from FIG. 18.
Figure 23:
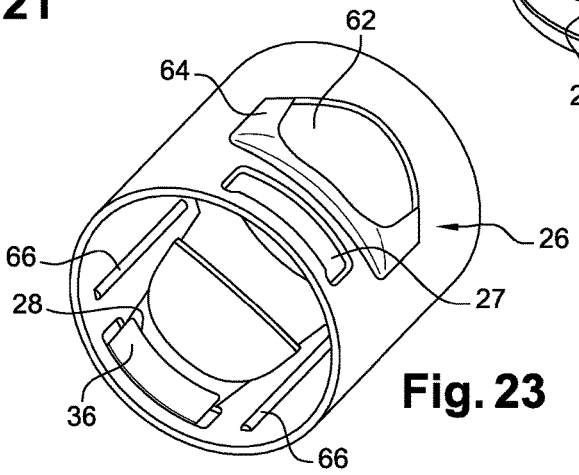
Figure 24:
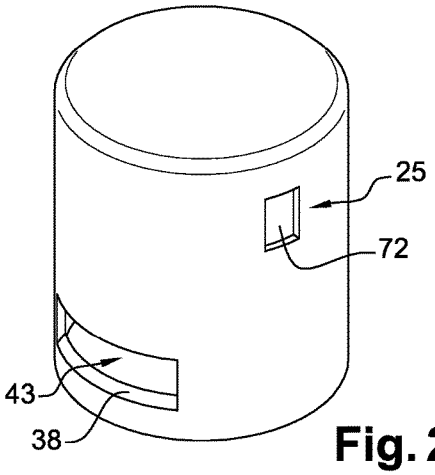
FIG. 24 is a perspective view of an internal cap member of the closure device from FIG. 18.

Differing form the first embodiment, the external cap member 26 includes two positioning openings 62 (FIGS. 21 to 23). These positioning openings 62 serve to position the fingers of a user in contact with the internal cap member 25. As shown in FIGS. 21 and 22, these positioning openings 62 are substantially diametrically opposite each other and each is delimited by an axial bearing engagement contour 64.

The cap assembly 25, 26 in accordance with the sixth embodiment includes means 66 for centering the external cap member 26 around the internal cap member 25. In actual fact, it will be noted that the internal cap member 25 and the external cap member 26 each include a substantially cylindrical lateral wall 67, 68, the lateral wall 68 of the external cap member 26 surrounding the lateral wall 67 of the internal cap member 25. These centering means 66 include four centering ribs 66, for example, carried by the lateral wall 68 of the external cap member 26 and arranged on respective opposite sides of each of the positioning openings 62 in this lateral wall 68.

In this embodiment, the internal cap member 25 and the external cap member 26 also include complementary axial guide means 69 for limiting the axial travel between them. In this example, as shown in FIGS. 21, 22 and 25, these complementary axial guide and axial travel limiting means 69 include at least one axial guide projection 70 carried by the external cap member 26 sliding axially in a complementary axial guide orifice 72 in the internal cap member 25.

The principal steps of manipulating the medical device 20 including the closure device 24 in accordance with the sixth embodiment are deduced, mutatis mutandis, from those of the medical device 20 including the closure device 24 in accordance with the first embodiment: FIGS. 19 and 20 are analogous to FIGS. 2 and 3. The following difference will be noted, however: a user manipulating the medical device 20 grasps the internal cap member 25 through the positioning opening 62 in the external cap member 26 to remove the cap assembly 25, 26 from the container 21 in accordance with an axial component (along A).

There is shown in FIGS. 26 to 33 a medical device 20 including a closure device 24 in accordance with a seventh embodiment of the invention. This closure device 24 is mounted on the container 21.

This seventh embodiment is similar to the previous embodiment. However, differing from the preceding embodiment, in addition to carrying centering means 66, complementary axial guide means 69 and means for limiting the axial travel between the internal cap member 25 and the external cap member 26, in this case the cap assembly 25, 26 includes means 74 for locking together the internal cap member 25 and the external cap member 26. These locking means 74, visible in FIGS. 29 to 32, are activated on releasing the internal cap member 25 relative to the container 21 by the action of the fingers of a user. These locking means 74 therefore include two elastic tongues 76 for contact with the fingers of a user and lying in respective openings 62 for positioning the fingers of that user. Each elastic tongue 76 includes a radial locking projection 78 that can be nested in a complementary locking orifice 80 in the lateral wall 67 of the internal cap member 25.

It will be noted that each elastic tongue 76 includes gripping projections 82 to optimize the contact with the fingers of the user.

Moreover, in this embodiment, as can be seen in FIGS. 27, 28, 32 and 33, the lateral walls 67, 68 of the internal cap member 25 and the external cap member 26 are each closed by an end wall 84 carrying axially acting elastic biasing means 60. In this seventh embodiment, the axially acting elastic biasing means 60 effect therefore include at least one elastic element 86 interleaved between the end walls 84 of the internal cap member 25 and the external cap member 26 and preferably at least one (for example three) abutments 88 for limiting the axial travel between the internal cap member 25 and the external cap member 26, interleaved between the end walls 84. In the example shown in FIGS. 32 and 33, the elastic biasing means 60 include three elastic elements 60 each formed by a puncture 60 in the end wall 84 of the internal cap member 25.

Figures 27, 28:
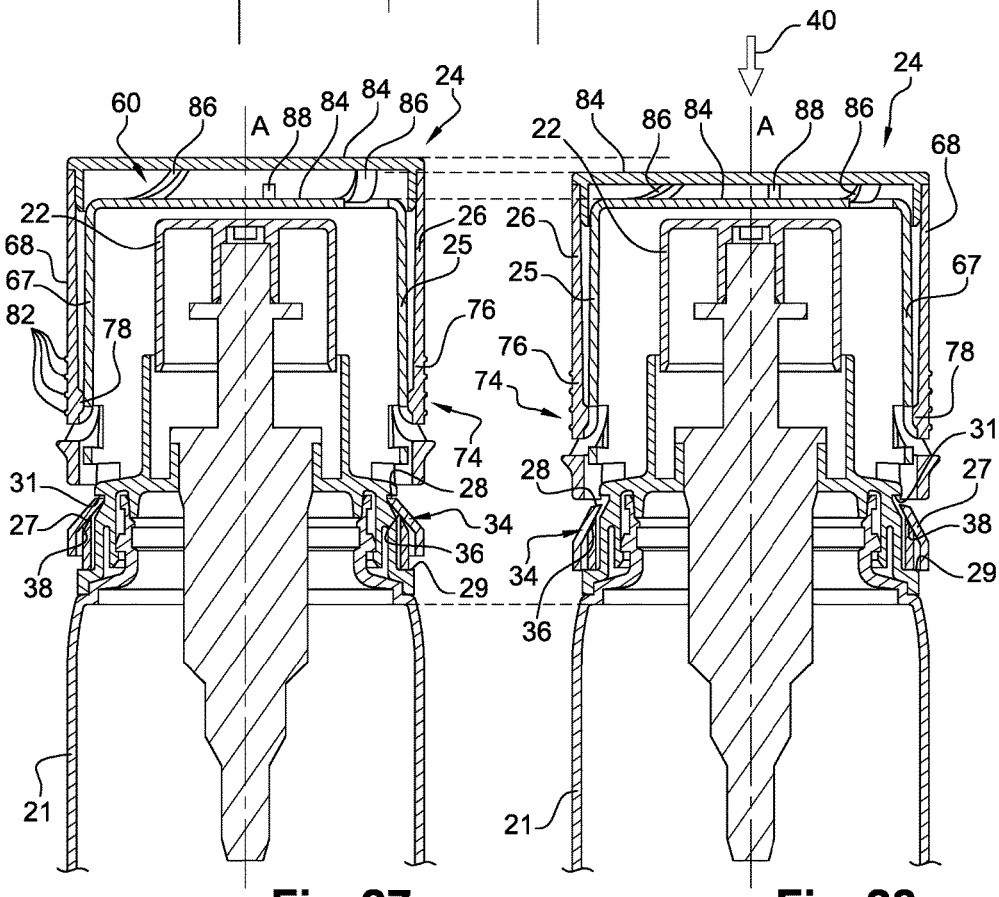
Figure 29:
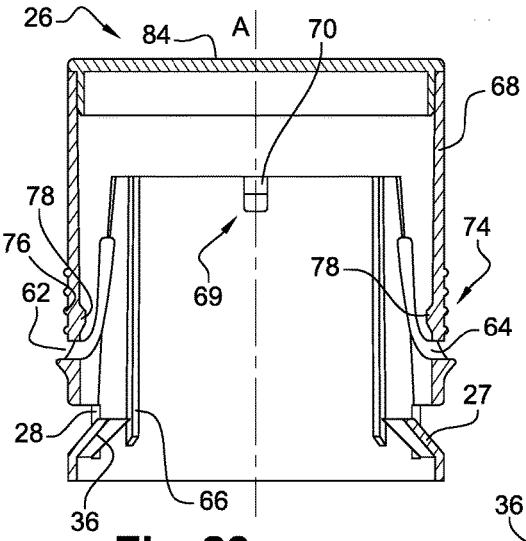
Figure 30:
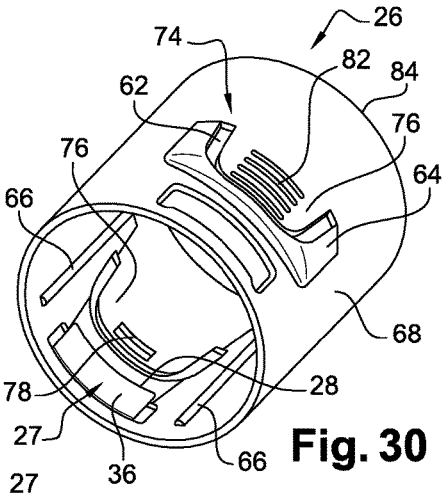
Figure 31:
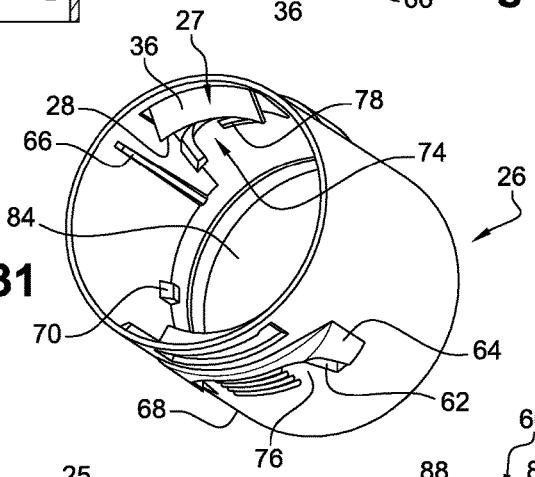
Figure 32:
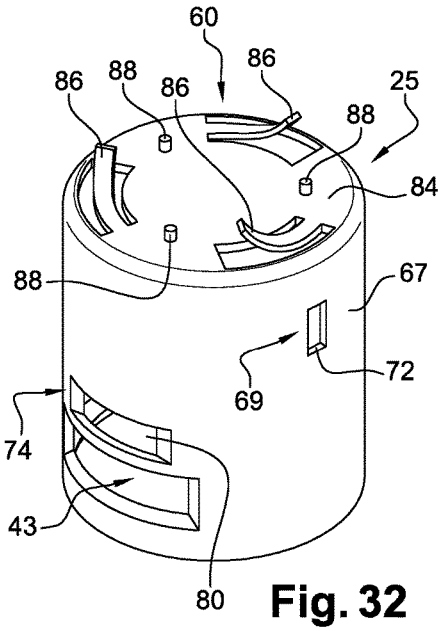
Figure 33:
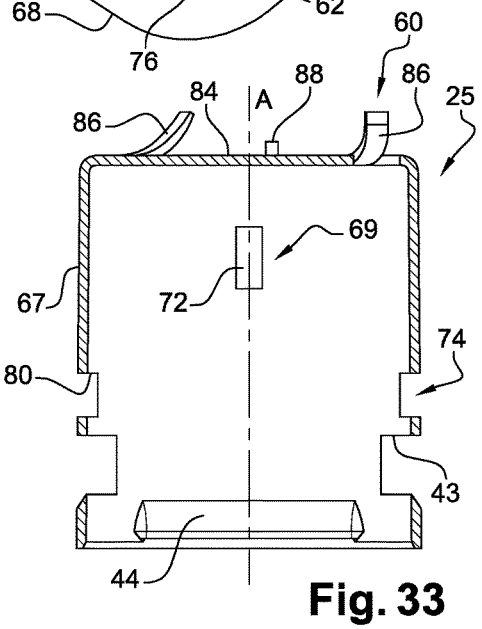

The principal steps of manipulating the medical device 20 including the closure device 24 in accordance with the seventh embodiment are deduced, mutatis mutandis, from those of the medical device 20 including the closure device 24 in accordance with the sixth embodiment: FIGS. 27 and 28 are analogous to FIGS. 19 and 20. However, the following difference will be noted: a user manipulating the medical device 20 grasps the internal cap member 25 via the locking means 74 of the cap assembly 25, 26. By exerting a lateral pressure on the elastic contact tongues 76 of the external cap member 26, the user therefore causes the radial locking projection 78 to be nested in the complementary locking orifice 80 in the internal cap member 25 and which enables pinching of the internal cap member 25 in order to be able to remove it from the container 21 in accordance with an axial component.

In a similar manner to the fifth embodiment, the axially acting elastic biasing means 60 effect bias the external cap member 26 toward a position favoring the cooperation position of the locking abutment 28 of the external cap member 26 with the complementary locking abutment 31 carried by the flange 32 of the retaining member 22 of the internal cap member 25 on the container 21. The abutments 88 for limiting the axial travel between the internal cap member 25 and the external cap member 26 prevent crushing of the biasing means 60.

There is shown in FIGS. 34 to 41 a medical device 20 including a closure device 24 in accordance with an eighth embodiment of the invention. This closure device 24 is mounted on the container 21.

This eighth embodiment is similar to the previous embodiment. However, differing from the previous embodiment, to prevent the axial movement (along A) of the external cap member 26 on the internal cap member 25 and therefore to prevent the closure device 24 changing from its protection position to its release configuration, the closure device 23 further includes a security abutment 90 fastened to the internal cap member 25. This security abutment 90, of substantially cylindrical shape, is fastened to the end wall 84 of the internal cap member 25 and is complementary to an opening 50 in the end wall 84 of the external cap member 26. This security abutment 90 therefore continues or comes to project through the end wall 84 of the external cap member 26 when the security means change from their protection configuration to their release configuration by virtue of the action of a user.

Figure 34:
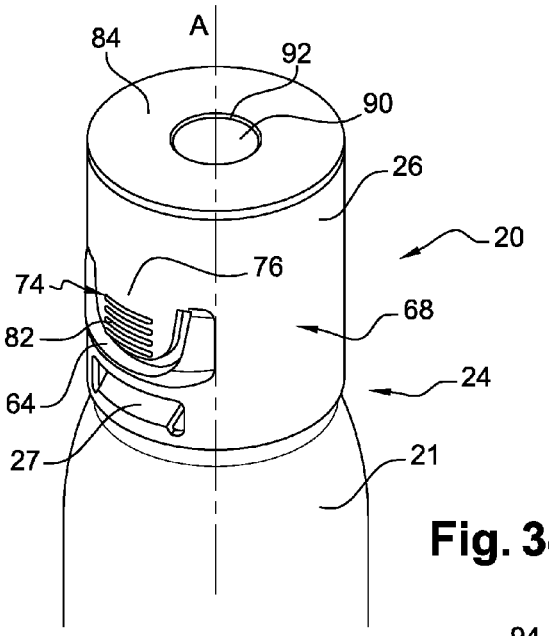
FIGS. 34 to 41 are FIGS. analogous to FIGS. 18 to 25 showing a medical device including a closure device in accordance with an eighth embodiment of the invention.
Figure 35:
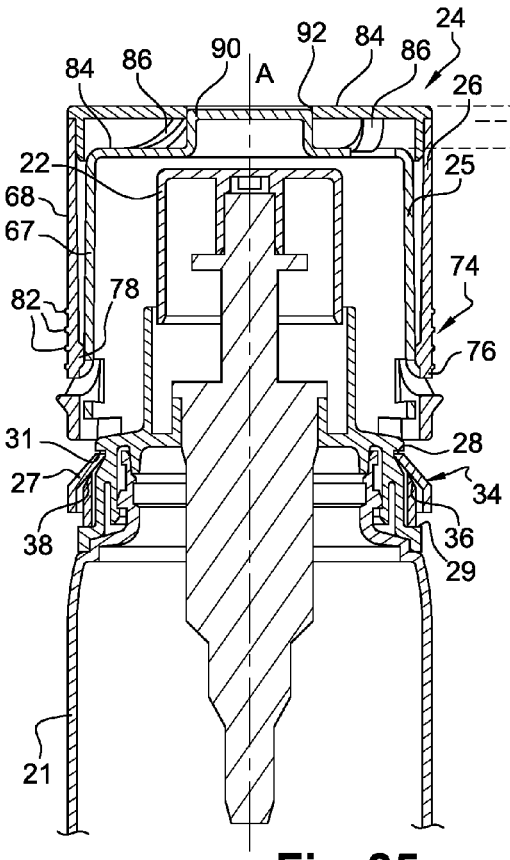

In the example shown, when the security element 27 is in the cooperation position, the security abutment 90 is flush with the end wall 84, as shown in FIGS. 34 and 35. Alternatively, in this cooperation position, the security abutment 90 could project slightly relative to the end wall 84.

The principal steps of manipulating the medical device 20 including the closure device 24 in accordance with the eighth embodiment are deduced, mutatis mutandis, from those of the medical device 20 including the closure device 24 in accordance with the seventh embodiment. The following difference will be noted, however: when a user wishes to move the external cap member 26 axially (along A) to move the security element 27 so as to open the medical device 20, they must exert an axial pressure on the end wall 84 (see arrows 94) of the external cap member 26 without exerting pressure on the security abutment 90.

Figure 36:
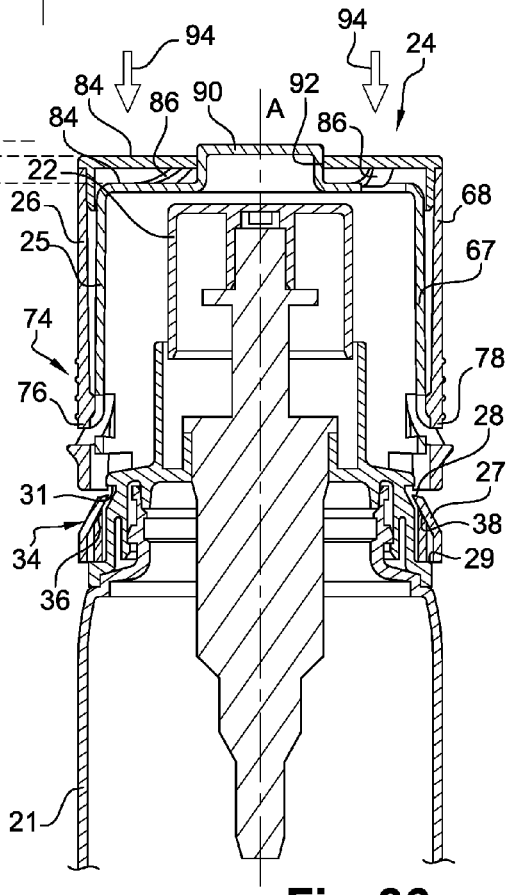
Figure 37:
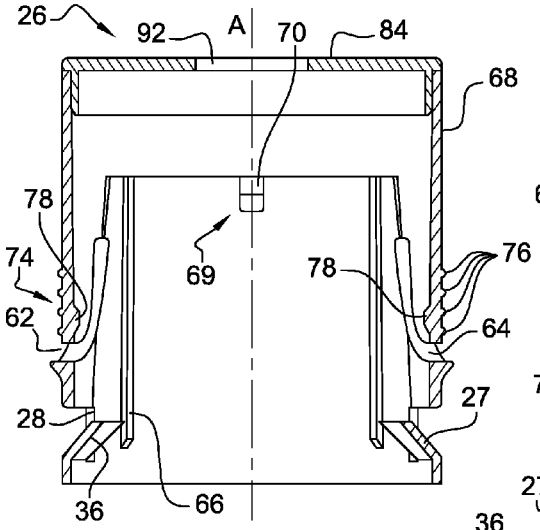
Figure 38:
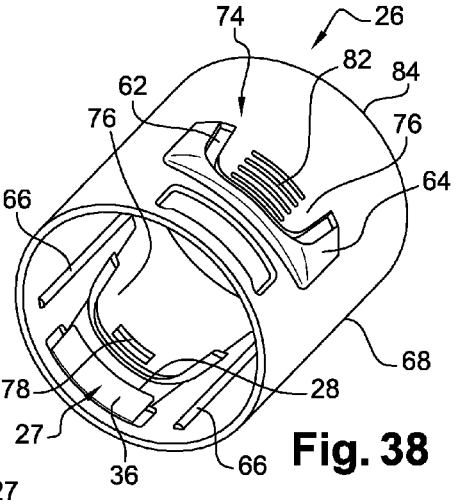
Figure 39:
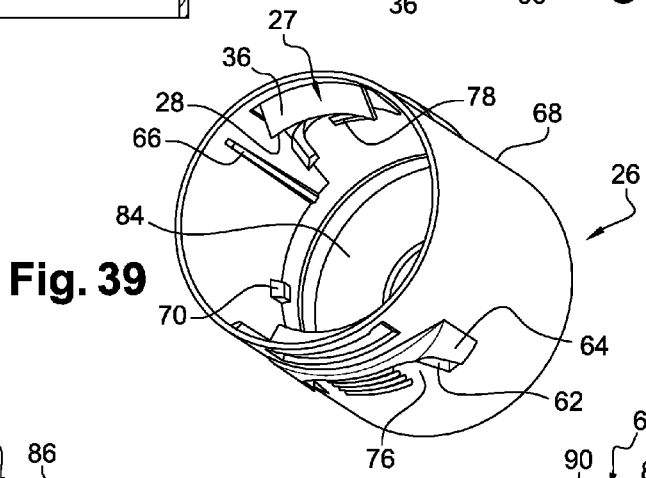
Figure 40:
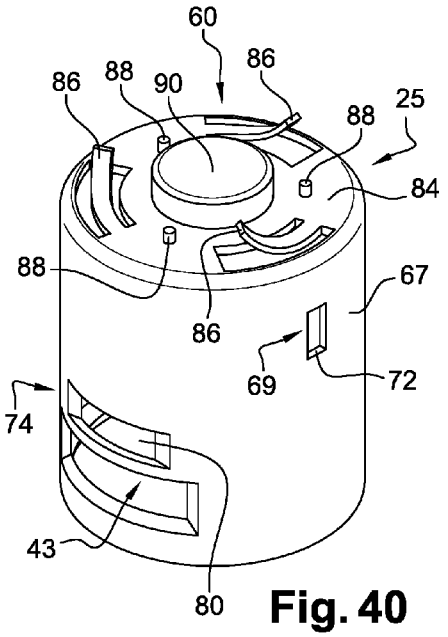
Figure 41:
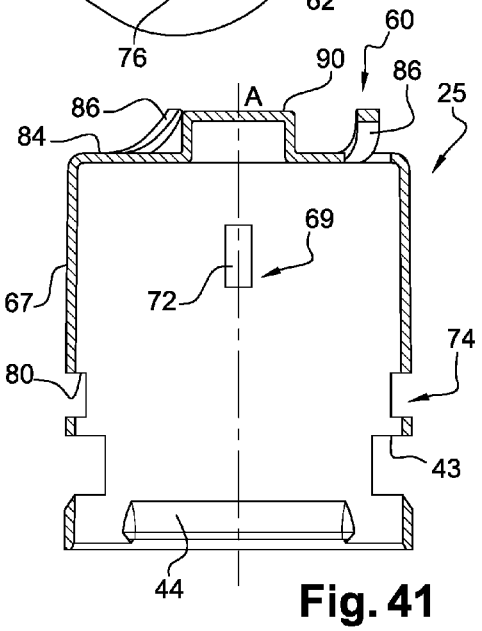

It is only in this case that the external cap member 26 will be moved axially and will allow the radial movement of the locking abutment 28, allowing the closure device 23 to move toward the separation position. The security abutment 90, which would be flush with the end wall 84 of the external cap member 26, then comes to project through the opening 92 in the end wall 84 of the external cap member 26, as can be seen in FIG. 36.

To close the medical device 20 again, the user clips the internal cap member 25 onto the dispensing tip 22 by moving it substantially axially (parallel to the axis A) toward that dispensing tip 22. The security projection 90 then returns to its flush position.

It will be noted that as soon as the user ceases to exert a force on the external cap member 26 in the direction 94 it returns instantaneously, by virtue of the elastic biasing effect, to its protection configuration and the security projection 90 then resumes its flush position.

The invention is not limited to the embodiments shown and other embodiments will be clearly apparent to the person skilled in the art.

In particular, it will be noted that the complementary locking abutment 31 may be carried by a member 22 for retaining the internal cap member 25 on the container 21 other than a product dispensing tip. This retaining member 22 may be mounted on the container 21 or made in one piece with that container 21.

Moreover, it is in particular possible to envisage a security abutment 90 projecting through the end wall 84 of the external cap member 26 even when the security element 27 is in the cooperation position.

What is claimed is:

1. A device for closing a container, of the type including a cap assembly including an internal cap member intended to be placed on the container or to be removed from that container by a relative movement between the internal cap member and the container including an axial component, wherein the device further includes an external cap member mounted to be axially mobile on the internal cap member, the external cap member carrying a security element including a locking abutment mobile radially between:

a cooperation position, favored by elastic biasing, in which the locking abutment is intended to cooperate with a complementary locking abutment carried by the container to retain the internal cap member on the container, and a separation position, in which the locking abutment is intended to be separated from the complementary locking abutment carried by the container to allow the release of the internal cap member relative to the container, wherein the device further includes a ramp carried by the security element intended to cooperate with a complementary ramp carried by the internal cap member for transforming the axial movement of the external cap member on the internal cap member into radial movement of the security element making it possible for the locking abutment to evolve from its cooperation position to its separation position by axial movement of the external cap member relative to the internal cap member in a direction identical to a direction of the axial component of the movement of the internal cap member toward the container during the placing of that internal cap member on the container, and wherein the security element extends radially through an orifice in the internal cap member and the complementary ramp carried by the internal cap member forms a portion of an edge of the orifice in the internal cap member.

2. The closure device as claimed in claim 1, wherein the external cap member is formed by at least one sector of a security ring around the internal cap member, the security element being carried by an internal surface of the sector of the security ring.

3. The closure device as claimed in claim 2, wherein the external cap member is formed by a security ring around the internal cap member.

4. The closure device as claimed in claim 1, including an axially acting elastic biasing element connected to the internal cap member or to the external cap member so as to bias the external cap member toward a position favoring the cooperation position of the locking abutment of the security element.

5. The closure device as claimed in claim 4 wherein the internal cap member and the external cap member each include a substantially cylindrical lateral wall closed by an end wall, the axially acting elastic biasing element including at least one elastic element interleaved between the end walls of the internal cap member and the external cap member.

6. The closure device as claimed in claim 5, wherein the axially acting elastic biasing element is formed by a puncture in the end wall of the internal cap member.

7. The closure device as claimed in claim 4 wherein the internal cap member and the external cap member each include a substantially cylindrical lateral wall closed by an end wall, at least one of the end walls the biasing element with axial elastic effect including at least one axial travel limiting abutment between the internal cap member and the external cap member interleaved between the end walls.

8. The closure device as claimed in claim 1, wherein the security element includes at least two security elements regularly distributed on the external cap member around an axis parallel to the axial direction of movement of the external cap member on the internal cap member.

9. The closure device as claimed in claim 1, including bosses carried by the internal cap member, intended to cooperate with the complementary locking abutment carried by the container to prevent unintentional separation of the internal cap member relative to the container when the locking abutment of the security element is in its separation position.

10. The closure device as claimed in claim 1, wherein the external cap member includes two openings for positioning the fingers of a user, these openings being each delimited by a contour forming an axial bearing surface.

11. The closure device as claimed in claim 10, wherein the cap assembly includes locking mechanisms for locking together the internal cap member and the external cap member, activated on release of the internal cap member relative to the container, including two elastic tongues for contact with the fingers of a user, respectively lying in the two openings for positioning the fingers of that user, each elastic tongue including a radial locking projection that can be nested in a complementary locking orifice in the internal cap member.

12. The closure device as claimed in claim 1, wherein the assembly forming the cap includes centering ribs carried by the external cap member for centering the external cap member around the internal cap member.

13. The closure device as claimed in claim 1, wherein the locking abutment carried by the security element and the complementary locking abutment carried by the container are both axial abutments.

14. A medical device including a container and a device for closing that container, characterized in that the closure device is a device as claimed in claim 1.

15. The medical device as claimed in claim 14, wherein the container includes a tip for dispensing a product contained in the container, the tip being mounted on the container or being made in one piece with the container.

16. A device for closing a container, of the type including a cap assembly including an internal cap member intended to be placed on the container or to be removed from that container by a relative movement between the internal cap member and the container including an axial component, wherein the device further includes an external cap member mounted to be axially mobile on the internal cap member, the external cap member carrying a security element including a locking abutment mobile radially between:

a cooperation position, favored by elastic biasing, in which the locking abutment is intended to cooperate with a complementary locking abutment carried by the container to retain the internal cap member on the container, and a separation position, in which the locking abutment is intended to be separated from the complementary locking abutment carried by the container to allow the release of the internal cap member relative to the container, wherein the device further includes a ramp carried by the security element intended to cooperate with a complementary ramp carried by the internal cap member for transforming the axial movement of the external cap member on the internal cap member into radial movement of the security element making it possible for the locking abutment to evolve from its cooperation position to its separation position by axial movement of the external cap member relative to the internal cap member in a direction identical to a direction of the axial component of the movement of the internal cap member toward the container during the placing of that internal cap member on the container, and wherein the internal cap member and the external cap member include complementary axial guide elements adapted to limit the axial travel between them, including at least one axial guide projection carried by the external cap member sliding axially in a complementary axial guide orifice in the internal cap member.

17. A device for closing a container, of the type including a cap assembly including an internal cap member intended to be placed on the container or to be removed from that container by a relative movement between the internal cap member and the container including an axial component, wherein the device further includes an external cap member mounted to be axially mobile on the internal cap member, the external cap member carrying a security element including a locking abutment mobile radially between:

a cooperation position, favored by elastic biasing, in which the locking abutment is intended to cooperate with a complementary locking abutment carried by the container to retain the internal cap member on the container, and a separation position, in which the locking abutment is intended to be separated from the complementary locking abutment carried by the container to allow the release of the internal cap member relative to the container, wherein the device further includes a ramp carried by the security element intended to cooperate with a complementary ramp carried by the internal cap member for transforming the axial movement of the external cap member on the internal cap member into radial movement of the security element making it possible for the locking abutment to evolve from its cooperation position to its separation position by axial movement of the external cap member relative to the internal cap member in a direction identical to a direction of the axial component of the movement of the internal cap member toward the container during the placing of that internal cap member on the container, and wherein the internal cap member and the external cap member each include a lateral wall closed by an end wall, the device further including a security abutment fastened to the internal cap member that continues or comes to project through the end wall of the external cap member when the security element moves from its cooperation position to its separation position.

* * * * *